US010215102B2

(12) United States Patent
Yanagihara et al.

(10) Patent No.: US 10,215,102 B2
(45) Date of Patent: Feb. 26, 2019

(54) FAIL SAFE DEVICE OF ENGINE

(71) Applicant: SUBARU CORPORATION, Tokyo (JP)

(72) Inventors: Yuichi Yanagihara, Tokyo (JP); Chika Ozaki, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 63 days.

(21) Appl. No.: 15/623,641

(22) Filed: Jun. 15, 2017

(65) Prior Publication Data

US 2018/0038289 A1 Feb. 8, 2018

(30) Foreign Application Priority Data

Aug. 5, 2016 (JP) ..... 2016-154666

(51) Int. Cl.
*F02D 9/02* (2006.01)
*G07C 5/08* (2006.01)
*F02D 11/10* (2006.01)

(52) U.S. Cl.
CPC ..... *F02D 9/02* (2013.01); *F02D 11/107* (2013.01); *G07C 5/0841* (2013.01); *F02D 2009/0277* (2013.01); *F02D 2200/021* (2013.01); *F02D 2200/1004* (2013.01); *F02D 2200/1006* (2013.01); *F02D 2250/26* (2013.01)

(58) Field of Classification Search
CPC .... F02D 9/02; F02D 11/07; F02D 2009/0277; F02D 2200/021; F02D 2200/1004; F02D 2200/1006; F02D 2250/26; F02D 2200/0414; F02D 41/22; F02D 2041/226; F02D 2041/227; G07C 5/0841
USPC ..... 701/107
See application file for complete search history.

(56) References Cited

U.S. PATENT DOCUMENTS 4,907,409 A * 3/1990 Inoue ..... F02B 37/12 60/602
5,447,031 A * 9/1995 Betts ..... F01N 11/00 123/198 D
6,394,044 B1 * 5/2002 Bedapudi ..... F01P 7/04 123/196 AB
6,415,761 B1 * 7/2002 McKenzie ..... F01P 11/16 123/198 D
6,581,565 B2 * 6/2003 Heslop ..... F02D 41/1497 123/295

(Continued)

FOREIGN PATENT DOCUMENTS

JP 2010127162 A 6/2010

*Primary Examiner* — Thomas Moulis
*Assistant Examiner* — John Bailey
(74) *Attorney, Agent, or Firm* — Chip Law Group

(57) ABSTRACT

A fail safe device of an engine includes: a temperature setting module; a torque estimation module; and a torque monitoring module. The temperature setting module sets a value of a predetermined temperature parameter used in an estimation of a generation torque of the engine. The torque estimation module estimates the generation torque of the engine by using a set value of the predetermined temperature parameter set by the temperature setting module. The torque monitoring module decreases the generation torque of the engine, when the generation torque estimated by the torque estimation module is larger than a driver expected torque by a predetermined value or more.

17 Claims, 7 Drawing Sheets

(56) References Cited

U.S. PATENT DOCUMENTS

| | | | | |
|---|---|---|---|---|
| 6,679,110 | B2 * | 1/2004 | Oka | F01P 11/14 73/114.68 |
| 6,705,286 | B1 * | 3/2004 | Light | F02D 11/105 123/396 |
| 6,725,710 | B2 * | 4/2004 | Oka | F01P 11/14 73/114.68 |
| 9,487,207 | B2 * | 11/2016 | Nagashima | F02D 37/02 |
| 2002/0069011 | A1 * | 6/2002 | Hawkins | F02D 41/0007 701/104 |
| 2003/0079718 | A1 * | 5/2003 | Kadoi | B60H 1/3205 123/339.17 |
| 2003/0116103 | A1 * | 6/2003 | Murakami | F01P 7/167 123/41.1 |
| 2006/0213482 | A1 * | 9/2006 | Shibagaki | F02D 41/221 123/396 |
| 2007/0255485 | A1 * | 11/2007 | Kaita | B60K 6/445 701/102 |
| 2009/0173314 | A1 * | 7/2009 | Whitney | F02D 31/002 123/350 |
| 2010/0017164 | A1 * | 1/2010 | Wallin | G01L 25/003 702/104 |
| 2013/0204510 | A1 * | 8/2013 | Brinkmann | F02D 41/00 701/103 |
| 2013/0297112 | A1 * | 11/2013 | Gibson | B60W 20/50 701/22 |
| 2013/0297113 | A1 * | 11/2013 | Banker | B60W 20/00 701/22 |
| 2016/0244043 | A1 * | 8/2016 | Nefcy | B60W 10/26 |

* cited by examiner

FAIL SAFE DEVICE OF ENGINE

CROSS-REFERENCE TO RELATED APPLICATIONS

The present application claims priority from Japanese Patent Application No. 2016-154666 filed on Aug. 5, 2016, the entire contents of which are hereby incorporated by reference.

BACKGROUND

1. Technical Field

The present invention relates to a fail safe device of an engine.

2. Related Art

In an engine mounted on a vehicle, an intake air amount, a fuel injection amount, an ignition timing, etc. are controlled in accordance with an expected torque set on the basis of an accelerator depression amount of a driver and an expected torque set on the basis of constant speed cruise control or inter-vehicle distance control. In recent years, not only a fuel injection valve and a spark plug, but also an air intake throttle valve for adjusting an intake air amount employs an electronically controlled throttle valve. These fuel injection valve and air intake throttle valve are driven and controlled by an electronic control unit (ECU).

If the opening degree of the electronically controlled air intake throttle valve becomes uncontrollable, the oxygen amount in the air-fuel mixture introduced into the cylinder of the engine is unable to be controlled. Thus, it is concerned that sudden acceleration occurs against the intention of the driver. Hence, when the opening degree of the air intake throttle valve becomes uncontrollable, the electronic control unit activates fail safe to fix the throttle opening degree to a preset limp home opening degree. The limp home opening degree is set to prevent an engine stall and to enable escape traveling (limp home), for example.

For example, Japanese Unexamined Patent Application Publication No. 2010-127162 discloses a fail safe device that includes a torque monitoring module that monitors an expected torque calculated on the basis of an accelerator depression amount and an engine generation torque and diagnoses an abnormality when the engine generation torque is larger than the expected torque by an abnormality determination value or more, and a fail safe module that executes a fail safe process for decreasing the engine generation torque at the time of satisfaction of a condition, such as receiving an abnormality diagnosis result from the torque monitoring module.

In order to estimate the engine generation torque, temperature parameters, such as a cooling water temperature, an oil temperature, or an intake air temperature of the engine, which are also used to control the driving force of the engine, are used for example. These temperature parameters are set on the basis of input values from temperature sensors, but a fail safe function must be guaranteed so as not to be lost even when the temperature parameters become abnormal values.

For example, when the parameter of the cooling water temperature of the engine becomes lower than the actual cooling water temperature, the electronic control unit incorrectly recognizes that the engine friction (mechanical friction loss) increases, and increases the air intake throttle opening degree to continue idle rotation. Thereby, the vehicle accelerates against the intention of the driver. In this case, if the parameter of the cooling water temperature of the engine, which indicates an abnormal value, is also used in the estimation of the engine generation torque by the fail safe function, the estimated engine generation torque is identical with the engine expected torque, and the unintentional acceleration is unable to be prevented. As a result, it is concerned that the function of the fail safe device is lost.

SUMMARY OF THE INVENTION

It is desirable to provide a new and improved fail safe device of an engine which is capable of guaranteeing the fail safe function, even when the input value of the temperature parameter indicates an abnormal value.

An aspect of the present invention provides a fail safe device of an engine including: a temperature setting module configured to set a value of a predetermined temperature parameter used in an estimation of a generation torque of the engine; a torque estimation module configured to estimate the generation torque of the engine by using a set value of the predetermined temperature parameter set by the temperature setting module; and a torque monitoring module configured to decrease the generation torque of the engine, when the generation torque estimated by the torque estimation module is larger than a driver expected torque by a predetermined value or more. The temperature setting module maintains a current set value of the predetermined temperature parameter when a difference between an input value of the predetermined temperature parameter and the current set value exceeds a predetermined change amount restrictive value, and updates the set value with the input value of the predetermined temperature parameter when the difference between the input value of the predetermined temperature parameter and the current set value does not exceed the predetermined change amount restrictive value.

When the difference between the input value of the predetermined temperature parameter and the current set value exceeds the predetermined change amount restrictive value, the temperature setting module may maintain the current set value of the predetermined temperature parameter and increase the predetermined change amount restrictive value for use in a next comparison.

The temperature setting module may set the predetermined change amount restrictive value ($\alpha$) on the basis of equation (1) below.

$$\alpha=\alpha_0\times(N+1) \tag{1}$$

where $\alpha$ is the change amount restrictive value;

$\alpha_0$ is a standard restrictive value; and

N is a number of consecutive times that exceed the change amount restrictive value.

When the difference between the input value of the predetermined temperature parameter and the current set value once exceeds the predetermined change amount restrictive value and then returns to the predetermined change amount restrictive value or less within a predetermined time, the temperature setting module may update the set value with the input value.

When the difference between the input value of the predetermined temperature parameter and the current set value once exceeds the predetermined change amount restrictive value and then does not return to the predetermined change amount restrictive value or less even after a predetermined time, the temperature setting module may fix a subsequent set value to the current set value.

One or both of a cooling water temperature and an oil temperature of the engine may be used as the predetermined temperature parameter, and the predetermined change amount restrictive value may be a change amount restrictive value at a time of a decrease in the cooling water temperature or the oil temperature.

The predetermined temperature parameter may be an intake air temperature, and the predetermined change amount restrictive value may be a change amount restrictive value at a time of an increase in the intake air temperature.

The temperature setting module, the torque estimation module, and the torque monitoring module may be implemented in a computing unit configured to execute a drive control of the engine.

The torque monitoring module may fix an air intake throttle valve to a limp home opening degree.

DETAILED DESCRIPTION

Figure 1:
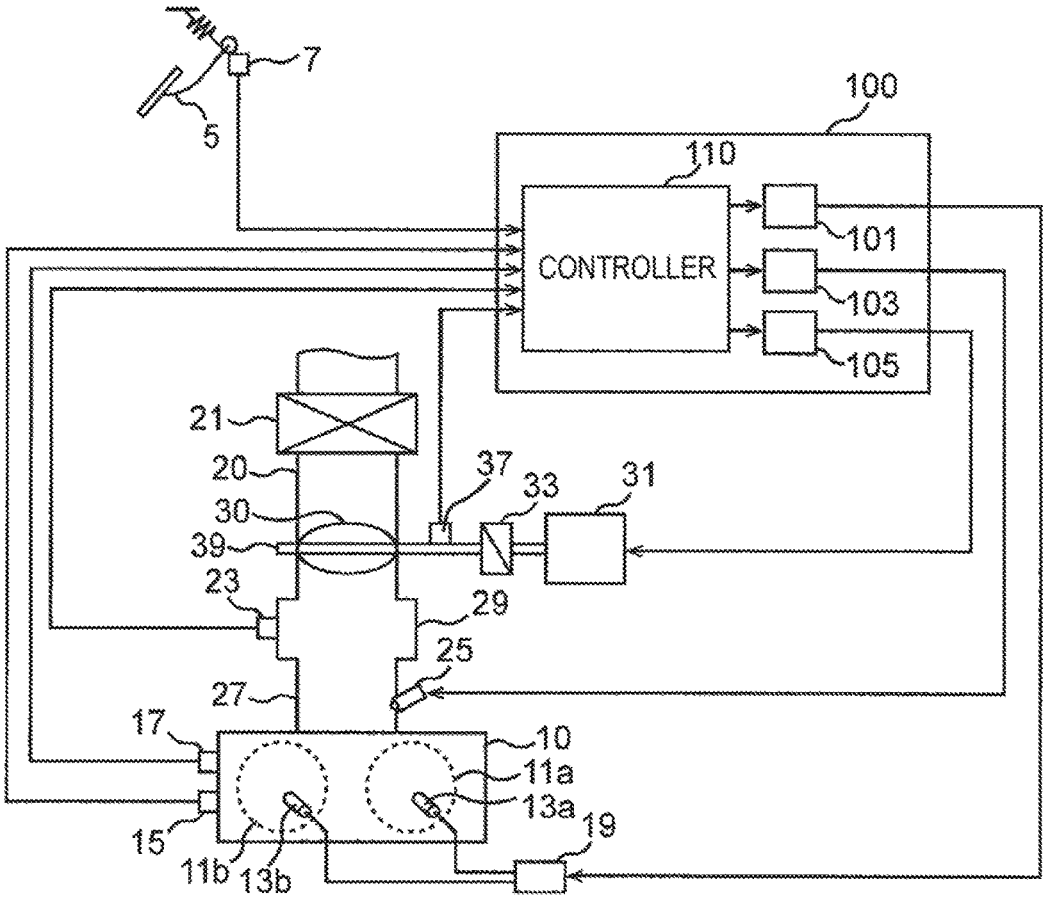
FIG. 1 is a schematic diagram illustrating a schematic configuration of an engine control system according to one example of the present invention.

Hereinafter, preferred examples of the present invention will be described in detail with reference to the appended drawings. Note that, in this specification and the appended drawings, structural elements that have substantially the same function and structure are denoted with the same reference numerals, and repeated description of these structural elements is omitted.

1. Engine Control System

First, an exemplary configuration of an engine control system that includes a fail safe device for an engine according to one example of the present invention will be described. FIG. 1 is a schematic configuration diagram of the engine control system. In the engine control system illustrated in FIG. 1, an air flow meter 21 is provided as a sensor for detecting an intake air amount, at an upstream side of an air intake passage 20 of an engine 10. An electronically controlled air intake throttle valve 30 is provided downstream of the air flow meter 21. A surge tank 29 is provided further downstream of the air intake throttle valve 30, and an intake air temperature sensor 23 for detecting an intake air temperature is provided on the surge tank 29. The intake air temperature sensor 23 may be a thermistor, for example. A fuel injection valve 25 is provided on an air intake port 27 that is interposed between the surge tank 29 and cylinders 11*a*, 11*b* of the engine 10.

Spark plugs 13*a*, 13*b* are provided in a cylinder block of the engine 10. The spark plugs 13*a*, 13*b* include ignition coils, and the ignition coils are coupled to an igniter 19. The spark plugs 13*a*, 13*b* release spark discharge to ignite air-fuel mixture in each cylinder 11*a*, 11*b*. These spark plugs 13*a*, 13*b*, the fuel injection valve 25, and the air intake throttle valve 30 are driven and controlled by an electronic control unit (ECU) 100.

The electronically controlled air intake throttle valve 30 is linked via a gear 33 to a motor 31 as a drive unit. The motor 31 drives axial rotation of a shaft 39 to which the air intake throttle valve 30 is fixed, in order to change the air intake throttle opening degree. The motor 31 may be a DC motor or a stepping motor, for example. The motor 31 is driven and controlled by the ECU 100. The air intake throttle valve 30 includes a throttle sensor 37 for detecting a rotational angle of the shaft 39. For example, assuming that the rotational angle of the shaft 39 is 0° when the air intake throttle valve 30 lies along the axial direction of the air intake passage 20, the air intake throttle opening degree becomes 100% when the rotational angle of the shaft 39 is 0°, and the air intake throttle opening degree becomes 0% when the rotational angle of the shaft 39 is 90°.

A cooling water temperature sensor 15 for detecting a cooling water temperature and an oil temperature sensor 17 for detecting an oil temperature are provided in the cylinder block of the engine 10. The cooling water temperature sensor 15 and the oil temperature sensor 17 may be a thermistor, for example. Also, an engine speed sensor for detecting a rotation speed of a crankshaft and other sensors (not depicted) for detecting engine driving states are provided in the engine 10. Outputs of various types of sensors, which include the above air flow meter 21, the intake air temperature sensor 23, and the throttle sensor 37, are input into the ECU 100. Also, an output of an accelerator sensor 7 for detecting a depression amount of an accelerator pedal 5 by a driver is input into the ECU 100.

The ECU 100 includes a controller 110, a spark plug drive circuit 101, a fuel injection valve drive circuit 103, and a throttle drive circuit 105. The controller 110 is configured with a central processing unit (CPU) and a circuit substrate, for example. Also, the controller 110 includes storage elements, such as a read only memory (ROM), a random access memory (RAM), and an electrically erasable programmable read only memory (EEPROM) (not depicted).

For example, the controller 110 executes a computer program stored in the storage element, to execute various types of computation processing by using various temperature parameters, and outputs drive command signals to the spark plug drive circuit 101, the fuel injection valve drive circuit 103, and the throttle drive circuit 105. The spark plug drive circuit 101, the fuel injection valve drive circuit 103, and the throttle drive circuit 105 drive the igniter 19, the fuel injection valve 25, and the motor 31 respectively in accordance with the drive command signals.

2. Fail Safe Device

Next, a fail safe device of the engine according to the present example, which is provided in the engine control system, will be described. In the engine control system according to the present example, the ECU 100 serves as the fail safe device. The example below will be described, taking an example of the ECU 100 that executes a fail safe process for the air intake throttle valve 30.

Figure 2:
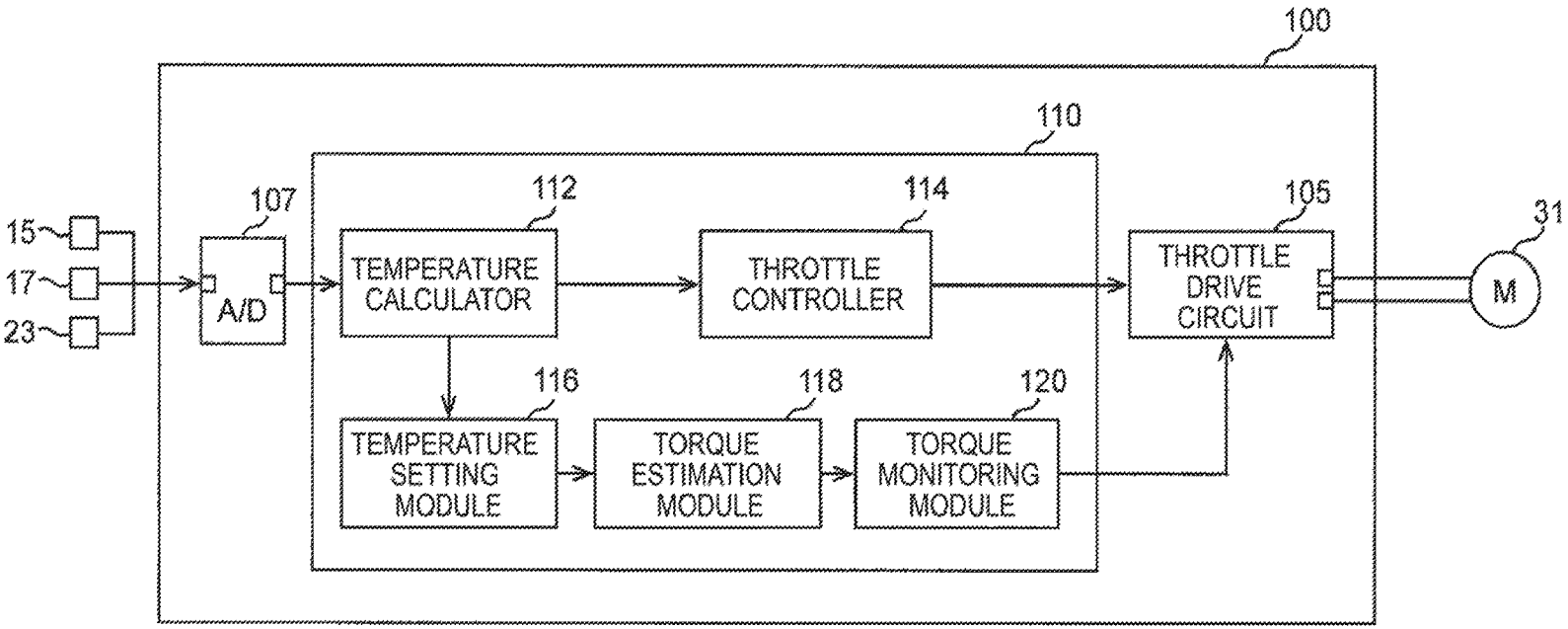
FIG. 2 is a block diagram illustrating an exemplary configuration of an ECU according to the example.

FIG. 2 is a block diagram illustrating an exemplary configuration of a part of the ECU 100 that is related to the fail safe process for the air intake throttle valve 30. The ECU 100 includes an A/D converter 107, the controller 110, and the throttle drive circuit 105. The controller 110 configured with a CPU or the like includes a temperature calculator 112, a throttle controller 114, a temperature setting module 116, a torque estimation module 118, and a torque monitoring module 120. Each of these modules is a function module implemented by execution of a computer program by the CPU.

2-1. A/D Converter

The A/D converter 107 converts analog signals inputs from the cooling water temperature sensor 15, the oil temperature sensor 17, and the intake air temperature sensor 23 to digital signals, and outputs the digital signals to the controller 110. In the ECU 100 according to the present example, the analog signal output from each temperature sensor is a voltage signal that changes with the detected temperature, and the A/D converter 107 converts the analog voltage signal to a digital voltage signal.

2-2. Temperature Calculator

The temperature calculator 112 of the controller 110 converts the digital signal (V) input from the A/D converter 107 to temperature information (° C.), and calculates a cooling water temperature Tc, an oil temperature To, and an intake air temperature Ta as temperature parameters. The temperature calculator 112 may execute a denoising process by filtering or the like. The temperature calculator 112 receives the digital voltage signal output from the A/D converter 107 in each preset process cycle, and calculates the cooling water temperature Tc, the oil temperature To, and the intake air temperature Ta.

2-3. Throttle Controller

The throttle controller 114 sets a target throttle opening degree (%), with reference to a throttle opening degree map, on the basis of an expected torque Tq_exp set on the basis of an accelerator depression amount Acc by the driver, an engine speed Ne, etc. As the expected torque Tq_exp is larger, the necessary oxygen amount to be supplied to the cylinders 11*a*, 11*b* of the engine 10 increases, and thus the target throttle opening degree is set to a larger value. The throttle controller 114 calculates the rotational angle (°) of the shaft 39 of the air intake throttle valve 30 from the set target throttle opening degree, and decides the electric power to be supplied to the motor 31, and outputs a drive command to the throttle drive circuit 105.

In this case, the air intake throttle opening degree is set on the basis of at least one of temperature parameters such as the cooling water temperature Tc, the oil temperature To, or the intake air temperature Ta. For example, the cooling water temperature Tc and the oil temperature To have an influence on the combustion efficiency in the cylinders 11*a*, 11*b* of the engine 10, and the intake air temperature Ta has an influence on the oxygen concentration in the intake air. For example, when the cooling water temperature Tc is low, the temperature near the air intake port 27 is low, and gasification of gasoline is incomplete, resulting in reduction in the amount of gasoline that combusts actually. Thus, the intake air amount may be corrected to increase as the cooling water temperature Tc becomes lower. Also, when the intake air temperature Ta is low, the oxygen density in the intake air becomes high. Thus, the intake air amount may be corrected to increase as the intake air temperature Ta becomes lower.

2-4. Temperature Setting Module

The temperature setting module 116 sets a temperature parameter used in estimation of the generation torque Tq_est of the engine 10, on the basis of the information of the cooling water temperature Tc, the oil temperature To, and the intake air temperature Ta input from the temperature calculator 112. The temperature setting module 116 compares the input value T of the temperature parameter and a current set value Pt in each process cycle. The temperature setting module 116 maintains the current set value Pt of the temperature parameter, when the difference between the input value T of the temperature parameter and the current set value Pt exceeds a predetermined change amount restrictive value $\alpha$. Also, the temperature setting module 116 updates the set value Pt with the input value T of the temperature parameter, when the difference between the input value T of the temperature parameter and the current set value Pt does not exceed the predetermined change amount restrictive value $\alpha$.

The change amount restrictive value $\alpha$ may be set as appropriate to a larger value than the assumed maximum change amount of the temperature parameter in a process cycle. For example, when the process cycle is 8 milliseconds, and the assumed maximum change amount of the cooling water temperature Tc is 20 to 30° C., the change amount restrictive value $\alpha$ may be set to 40 to 50° C. That is, when the change of the temperature parameter input from the temperature calculator 112 exceeds the assumed change amount, it is concerned that malfunction of the temperature sensor or the ECU 100 has occurred. Hence, the temperature setting module 116 prevents such an abnormal input value T from being used in the estimation of the generation torque Tq_est of the engine 10.

Thereby, even when the air intake throttle opening degree is set on the basis of the abnormal input value T of the temperature parameter, the estimated generation torque Tq_est of the engine 10 is estimated by using the temperature parameter of a small difference from the actual temperature. Thereby, a fail safe function can be guaranteed to decrease the generation torque of the engine 10 when the estimated generation torque Tq_est of the engine 10 is larger than the expected torque Tq_exp by a predetermined value or more.

Figure 3:
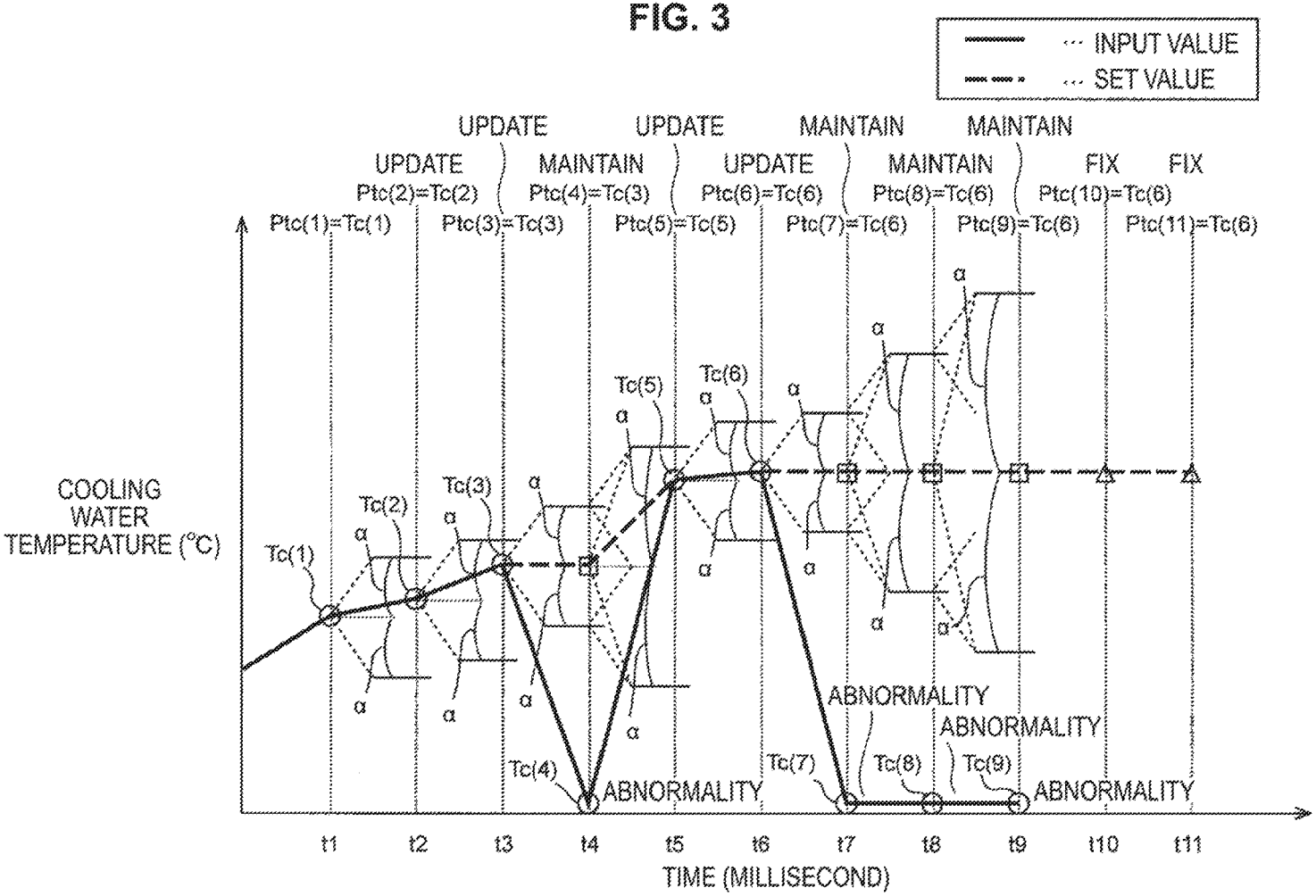
FIG. 3 is an explanatory diagram illustrating a temperature parameter setting process according to the example.

FIG. 3 is a diagram for describing a temperature parameter setting process by the temperature setting module 116 of the ECU 100 according to the present example. FIG. 3 illustrates, as one example, the setting process of the cooling water temperature Tc which is used in the estimation of the generation torque Tq_est of the engine 10. In FIG. 3, the thick solid line indicates transition of the input value Tc from the temperature calculator 112, and the thick dashed line indicates transition of the set value Ptc set by the temperature setting module 116.

The information of the cooling water temperature Tc(1), Tc(2), . . . , Tc(n) calculated by the temperature calculator 112 is input into the temperature setting module 116 in each process cycle t1 to t11. The interval (millisecond) of the process cycle t1 to t11 may be set as appropriate, depending on the throughput of the electronic control unit 100. The temperature setting module 116 sets the input value Tc(1) of the cooling water temperature Tc to a set value Ptc(1), in a first process cycle t1, for example a first process cycle t1 after start-up of the ECU 10 (Ptc(1)=Tc(1)).

In a subsequent second process cycle t2, the input value Tc(2) of the cooling water temperature Tc does not exceed the upper limit value obtained by adding the change amount restrictive value α to the current set value Ptc(1), and is not smaller than the lower limit value obtained by subtracting the change amount restrictive value α from the current set value Ptc(1). Hence, the temperature setting module 116 updates the set value Ptc(2) with the input value Tc(2) of this time (Ptc(2)=Tc(2)).

In a subsequent third process cycle t3, the input value Tc(3) of the cooling water temperature Tc does not exceed the upper limit value obtained by adding the change amount restrictive value α to the current set value Ptc(2), and is not smaller than the lower limit value obtained by subtracting the change amount restrictive value α from the current set value Ptc(2). Hence, the temperature setting module 116 updates the set value Ptc(3) with the input value Tc(3) of this time (Ptc(3)=Tc(3)).

In a subsequent fourth process cycle t4, the input value Tc(4) of the cooling water temperature Tc is smaller than the lower limit value obtained by subtracting the change amount restrictive value α from the current set value Ptc(3). Hence, the temperature setting module 116 maintains the set value Ptc(4) at the current set value Ptc(3). This is because, when the input value Tc(4) of the cooling water temperature indicates an abnormal value, the difference between the set value Ptc(4) and the actual cooling water temperature Tc is made smaller by maintaining the current set value Ptc(3), assuming that the actual cooling water temperature Tc is within a range delimited by the predetermined change amount restrictive value α with respect to a center value at the current set value Ptc(3).

Also, when the difference between the input value Tc(4) of the cooling water temperature and the current set value Ptc(3) is larger than the change amount restrictive value α, the change amount restrictive value α used in the computation processing of the next fifth process cycle t5 is increased and is set to a larger value. For example, the change amount restrictive value α may be set by using equation (1) below.

$$\alpha=\alpha_0\times(N+1) \tag{1}$$

where

α is the change amount restrictive value;

$\alpha_0$ is a standard restrictive value; and

N is the number of consecutive times that exceed the change amount restrictive value.

The standard restrictive value α0 is set to a larger value than the assumed maximum change amount of the temperature parameter in a process cycle, as described above, and the change amount restrictive value α is set to the standard restrictive value α0 as long as the difference between the input value Tc(4) of the cooling water temperature and the current set value Ptc(3) is not larger than the change amount restrictive value α (N=0). That is, the change amount restrictive value α calculated by the above equation (1) is set to a larger value, each time the number of times when the difference between the input value Tc of the cooling water temperature and the current set value Ptc is larger than the change amount restrictive value α increases. Thereby, the next change amount restrictive value α is set, assuming that the actual cooling water temperature Tc changes to the fullest within the range of the change amount restrictive value α with respect to a center value at the current set value Ptc.

Note that the setting method that increases the change amount restrictive value α is not limited to the example that uses the above equation (1). Although, in the example of the above equation (1), the change amount restrictive value α increases 2 times, 3 times . . . each time the number of times when the input value Tc indicates an abnormality increases consecutively, the change amount restrictive value α may increase by a value multiplied by a predetermined coefficient C as in equation (2) below, for example.

$$\alpha=\alpha_0+C\times N\times\alpha_0 \tag{2}$$

where

α is the change amount restrictive value;

$\alpha_0$ is the standard restrictive value;

C is a coefficient; and

N is the number of consecutive times that exceed the change amount restrictive value.

In the subsequent fifth process cycle t5, the input value Tc(5) of the cooling water temperature Tc does not exceed the value obtained by adding the change amount restrictive value α to the current set value Ptc(3), and is not smaller than the lower limit value obtained by subtracting the change amount restrictive value α from the current set value Ptc(3). Hence, the temperature setting module 116 updates the set value Ptc(5) with the input value Tc(5) of this time (Ptc(5)=Tc(5)). The difference between the input value Tc(5) of the cooling water temperature and the current set value Ptc(3) returns within the change amount restrictive value α, and thus the change amount restrictive value α used in the next process cycle, which is set by using the above equation (1), is set back to the standard restrictive value α0.

In a subsequent sixth process cycle t6, the input value Tc(6) of the cooling water temperature Tc does not exceed the upper limit value obtained by adding the change amount restrictive value α to the current set value Ptc(5), and is not smaller than the lower limit value obtained by subtracting the change amount restrictive value α from the current set value Ptc(5). Hence, the temperature setting module 116 updates the set value Ptc(6) with the input value Tc(6) of this time (Ptc(6)=Tc(6)).

In a subsequent seventh process cycle t7, the input value Tc(7) of the cooling water temperature Tc is smaller than the lower limit value obtained by subtracting the change amount restrictive value α from the current set value Ptc(6). Hence, the temperature setting module 116 maintains the set value Ptc(7) at the current set value Ptc(6).

Also in a subsequent eighth process cycle t8 and a ninth process cycle t9, the input values Tc(8), Tc(9) of the cooling water temperature Tc are smaller than the lower limit value obtained by subtracting the change amount restrictive value α, which is set by using the above equation (1), from the current set value Ptc(6). Hence, the temperature setting module 116 maintains the set values Ptc(8), Ptc(9) at the current set value Ptc(6).

In this case, in the example of FIG. 3, when the number of times when the difference between the input value Tc of the cooling water temperature and the current set value Ptc consecutively exceeds the change amount restrictive value α becomes equal to or larger than 3 times, the set value Ptc of the cooling water temperature which is used in the subsequent calculation of the generation torque Tq_est of the engine 10 is fixed to the current set value Ptc. That is, in the ninth process cycle, the number of times when the difference between the input value Tc(9) of the cooling water temperature and the current set value Ptc(6) consecutively exceeds the change amount restrictive value α is equal to 3 times, and thus in process cycles at or after a tenth process cycle, the set values Ptc(9), Ptc(10), Ptc(11) are fixed. This is because, when the abnormality of the input value Tc of the cooling water temperature continues a predetermined number of times or more, it is difficult to guarantee that the input value Tc is not abnormal, even if the difference between the input value Tc and the set value Ptc is within the range of the change amount restrictive value α which is set by using the above equation (1) or the like.

As described above, the temperature setting module 116 updates the set value Ptc with the input value Tc, when the difference between the input value Tc of the cooling water temperature and the current set value Ptc once exceeds the change amount restrictive value α and then returns within the change amount restrictive value α within a predetermined time (within 3 cycles in the above example). Also, the temperature setting module 116 fixes the subsequent set value Ptc to the current set value Ptc, when the difference between the input value Tc of the cooling water temperature and the current set value Ptc once exceeds the change amount restrictive value α and then does not return within the change amount restrictive value α for more than the predetermined time (3 cycles in the above example). For example, the temperature setting module 116 maintains the fixation of the set value Ptc of the cooling water temperature that is used in the estimation of the generation torque of the engine 10, until an ignition switch is turned off to end the driving cycle of this time.

As described above, the temperature setting module 116 sets the input value Tc as the temperature parameter that is used in the estimation of the generation torque Tq_est of the engine 10, as long as the input value Tc of the cooling water temperature does not indicate an abnormal value. On the other hand, the temperature setting module 116 maintains the previous set value as the temperature parameter that is used in the estimation of the generation torque Tq_est of the engine 10, when the input value Tc of the cooling water temperature indicates an abnormal value. Then, the temperature setting module 116 fixes, to the current set value, the temperature parameter that is used in the subsequent estimation of the generation torque Tq_est of the engine 10, when the input value Tc of the cooling water temperature is not reliable any more. Thereby, the generation torque Tq_est of the engine 10 which is estimated by the torque estimation module 118 is guaranteed not to significantly deviate from the actual generation torque.

Although the example illustrated in FIG. 3 monitors whether the input value Tc of the cooling water temperature has increased or decreased by more than the predetermined change amount restrictive value α with respect to the center value at the current set value Ptc, only whether the input value Tc of the cooling water temperature has decreased by more than the predetermined change amount restrictive value α from the current set value Ptc may be monitored. That is, it is more important for the fail safe function of the ECU 100 to prevent sudden acceleration that is not intended by the driver, and thus the fail safe function may monitor only a sharp fall of the cooling water temperature Tc, which might cause the air intake throttle opening degree to be increased due to a false recognition that the engine friction has increased rapidly.

Figure 4:
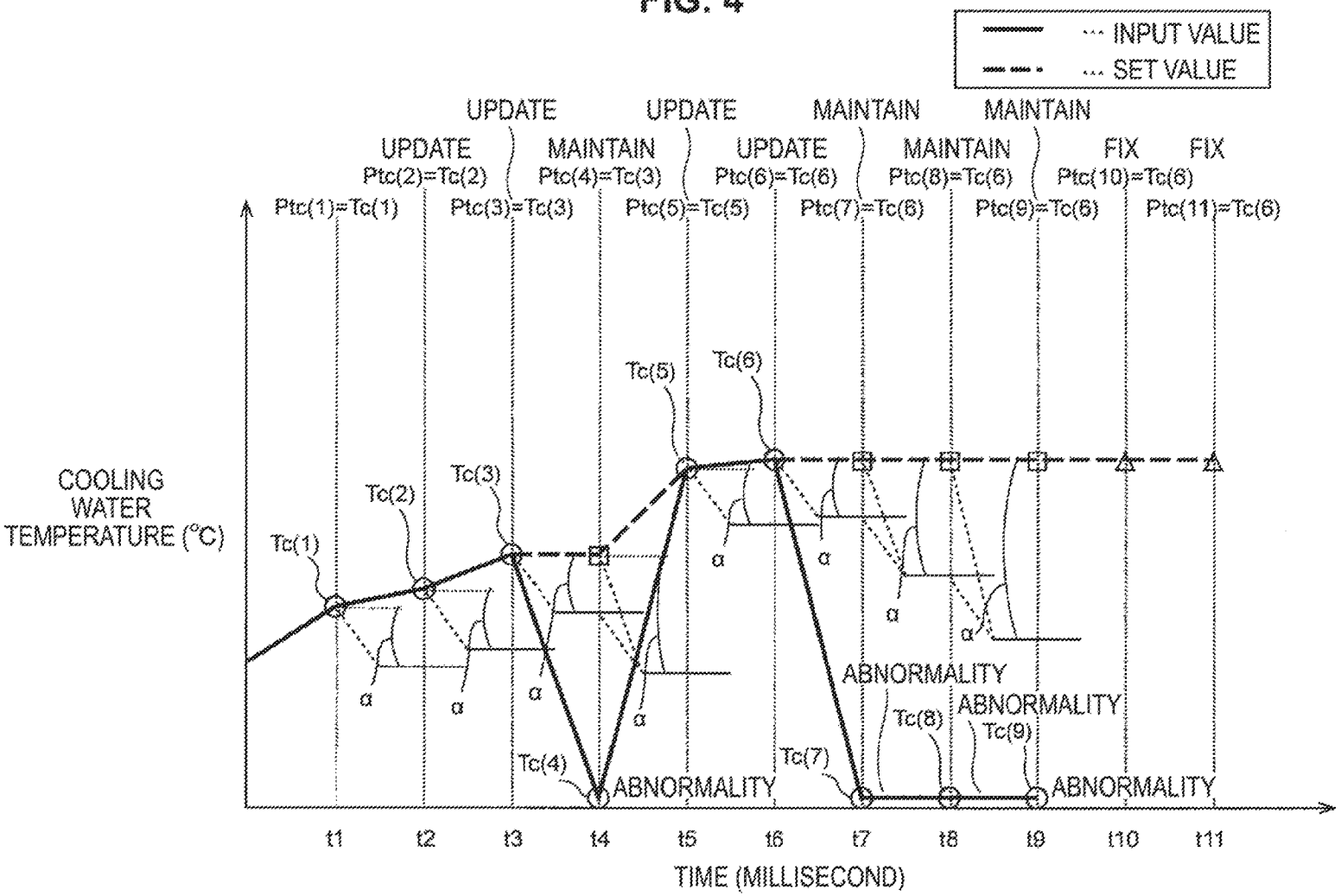
FIG. 4 is an explanatory diagram illustrating a cooling water temperature setting process according to the example.

FIG. 4 is an explanatory diagram illustrating an example in which the set value Ptc that is used in the estimation of the generation torque Tq_est of the engine 10 is set, while monitoring only whether the input value Tc of the cooling water temperature has decreased by more than the predetermined change amount restrictive value α from the current set value Ptc. In the example illustrated in FIG. 4 as well, the set value Ptc is maintained, when the input value Tc of the cooling water temperature sharply falls from the current set value Ptc by more than the predetermined change amount restrictive value α which is set by using the above equation (1) or the like. Also, when the difference value obtained by subtracting the input value Tc of the cooling water temperature from the current set value Ptc does not exceed the predetermined change amount restrictive value α, the set value Ptc is updated with the input value Tc.

With respect to not only the cooling water temperature Tc but also the oil temperature To and the intake air temperature Ta, the temperature setting module 116 calculates the set value Pto of the oil temperature To and the set value Pta of the intake air temperature Ta, which are used in the estimation of the generation torque Tq_est of the engine 10, in accordance with the above setting process of the cooling temperature Tc. Note that, in consideration of greater importance of the fail safe function of the ECU 100 that prevents sudden acceleration that is not intended by the driver, it is more important, with respect to the oil temperature To, to monitor whether the input value To has decreased by more than a predetermined change amount restrictive value α from the current set value Pto, in the same way as the cooling water temperature Tc.

On the other hand, with respect to the intake air temperature Ta, it is concerned that the ECU 100 incorrectly recognizes that the oxygen concentration in the intake air decreases at the time of an increase in the intake air temperature Ta, and increases the air intake throttle opening degree. Hence, with respect to the intake air temperature Ta, it is more important to monitor whether the input value Ta has increased by more than the predetermined change amount restrictive value α from the current set value Pta. Note that the change amount restrictive value α used in the setting of the set value Ptc of the cooling water temperature, the set value Pto of the oil temperature, and the set value Pta of the intake air temperature may be set to different values in accordance with the temperature change amounts that can be estimated for each temperature.

2-5. Torque Estimation Module

The torque estimation module 118 performs calculation for estimating the generation torque Tq_est of the engine 10. For example, the torque estimation module 118 estimates the generation torque Tq_est of the engine 10 on the basis of information such as engine speed Ne, intake air amount, fuel injection amount, ignition timing, cooling water temperature Tc, oil temperature To, intake air temperature Ta, etc. For example, the torque estimation module 118 calculates a basic generation torque on the basis of the engine speed Ne, the intake air amount, the fuel injection amount, the ignition timing, etc., by using a torque calculation map or the like. In this case, the torque estimation module 118 may correct the basic generation torque on the basis of the intake air temperature Ta that can have an influence on the oxygen concentration in the intake air.

Figure 5:
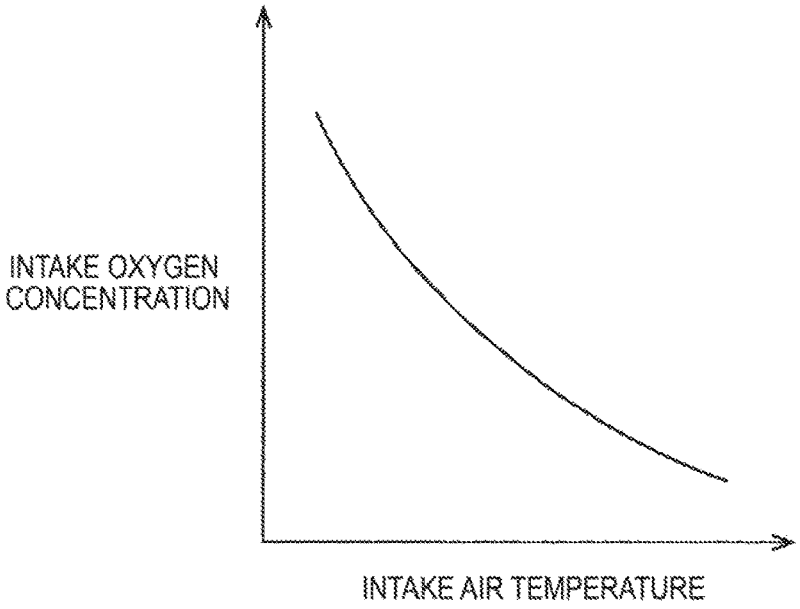
FIG. 5 is an explanatory diagram illustrating a relationship between an intake air temperature and an intake oxygen concentration.

FIG. 5 is an explanatory diagram illustrating a relationship between the intake air temperature Ta and the intake oxygen concentration. As illustrated in FIG. 5, as the intake air temperature becomes higher, the oxygen concentration in the intake air becomes lower. Thus, when the intake air amount is the same, the generation torque output from the engine 10 becomes smaller.

Also, the torque estimation module 118 estimates a net generation torque Tq_est, by subtracting minus elements of the torque, such as the engine friction, the load of the air conditioning device, the load of the alternator, and the load of the transmission, from the calculated basic generation torque. In this case, the engine friction can be set on the basis of one or both of the cooling water temperature Tc and the oil temperature To.

Figure 6:
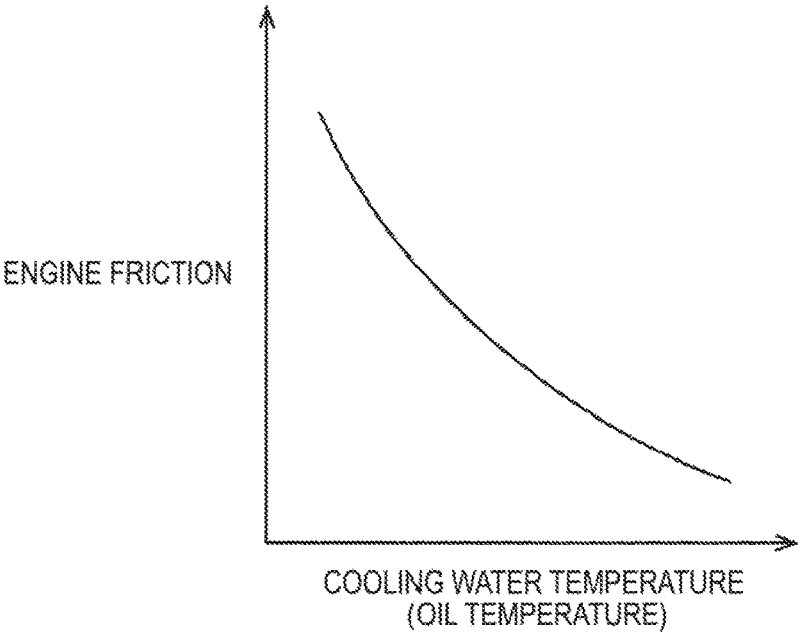
FIG. 6 is an explanatory diagram illustrating a relationship between a cooling water temperature (or an oil temperature) and engine friction.

FIG. 6 is an explanatory diagram illustrating a relationship between the cooling water temperature Tc or the oil temperature To and the engine friction. As illustrated in FIG. 6, as the cooling water temperature Tc or the oil temperature To becomes lower, the engine friction becomes larger. Thus, the generation torque output from the engine 10 becomes smaller.

In the ECU 100 according to the present example, the basic generation torque is calculated by using the set value Pta of the intake air temperature set by the temperature setting module 116. Also, the engine friction is set by using one or both of the cooling water temperature Tc and the oil temperature To set by the temperature setting module 116. Thus, while the input value T of the temperature parameter is reliable, the generation torque Tq_est of the engine 10 can be estimated by using the input value T. Also, when the input value T of the cooling water temperature indicates an abnormal value, or when the input value T of the temperature parameter is not reliable any more, the generation torque Tq_est of the engine 10 can be estimated by using the set value Pt having a smaller difference from the actual temperature parameter T. Thus, the estimated generation torque Tq_est of the engine 10 does not decrease due to the abnormality of the input value T of the temperature parameter. Thereby, when the input value T of the temperature parameter is an abnormal value, the estimated generation torque Tq_est of the engine 10 is calculated larger than the expected torque Tq_exp.

2-6. Torque Monitoring Module

The torque monitoring module 120 monitors the generation torque Tq_est of the engine 10 calculated by the torque estimation module 118, and decreases the generation torque of the engine 10 when the estimated generation torque Tq_est is larger than the expected torque Tq_exp by a predetermined value or more. For example, the torque monitoring module 120 compares the expected torque Tq_exp set on the basis of the accelerator depression amount Acc and the engine speed Ne, with the estimated generation torque Tq_est of the engine 10. Then, when the value obtained by subtracting the expected torque Tq_exp from the estimated generation torque Tq_est exceeds a preset threshold value β, the torque monitoring module 120 outputs a command signal to the throttle drive circuit 105, and causes the throttle drive circuit 105 to fix the air intake throttle opening degree to the limp home opening degree. Thereby, the fail safe function is activated to prevent sudden acceleration of the vehicle that is not intended by the driver.

The threshold value β may be set to an appropriate value in accordance with the specification of the engine 10, the allowable range of the acceleration of the vehicle, etc., for example. Also, the limp home opening degree can be set to an air intake throttle opening degree that can ensure a sufficient intake air amount to enable the vehicle to travel for escape, for example. Alternatively, the air intake throttle opening degree may be set to 0% as the limp home opening degree, in order to stop the vehicle immediately. In this case, the driver or the like may be warned by warning sound, voice sound, lamp display, image display, etc.

2-7. Throttle Drive Circuit

The throttle drive circuit 105 performs drive control of the motor 31 of the air intake throttle valve 30, on the basis of a drive command output from the throttle controller 114 of the controller 110, mainly. Thereby, the air intake throttle opening degree is adjusted in accordance with the expected torque Tq_exp. Also, when the throttle drive circuit 105 receives the drive command output from the torque monitoring module 120, the throttle drive circuit 105 performs the drive control of the motor 31 to fix the air intake throttle opening degree to the limp home opening degree. Thereby, the intake air amount supplied to the cylinders 11*a*, 11*b* of the engine 10 is reduced, and sudden acceleration of the vehicle is prevented.

3. Flowchart of Fail Safe Process

Figure 7:
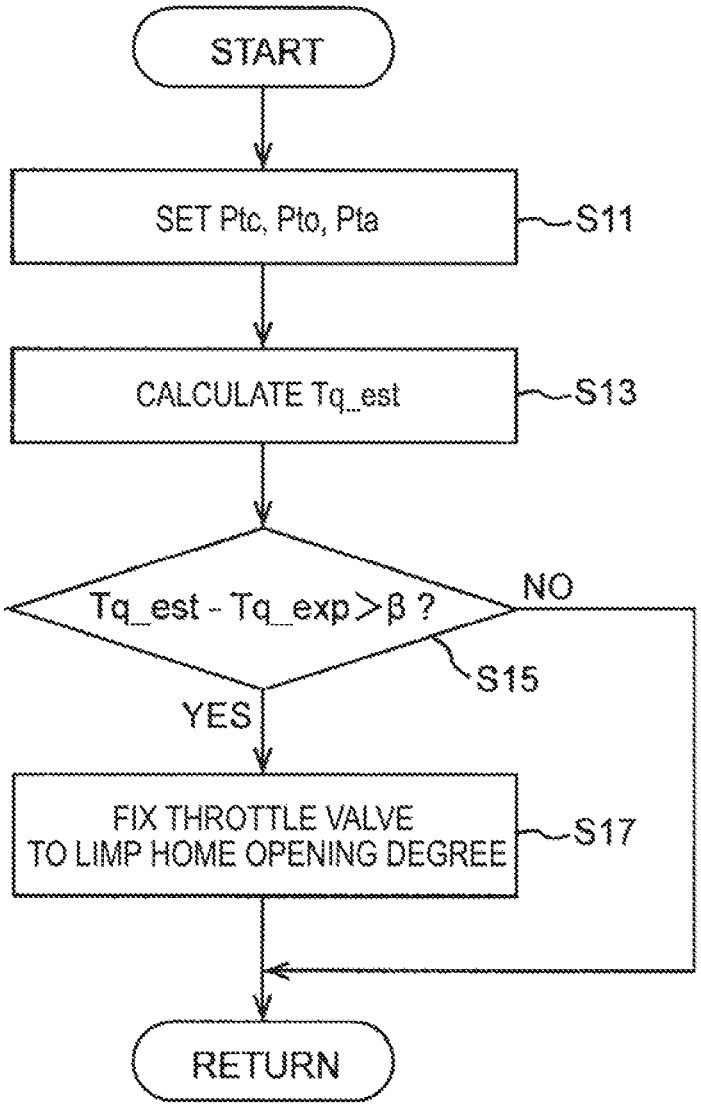
FIG. 7 is a flowchart illustrating a sequence of a fail safe process of an engine according to the example.
Figure 8:
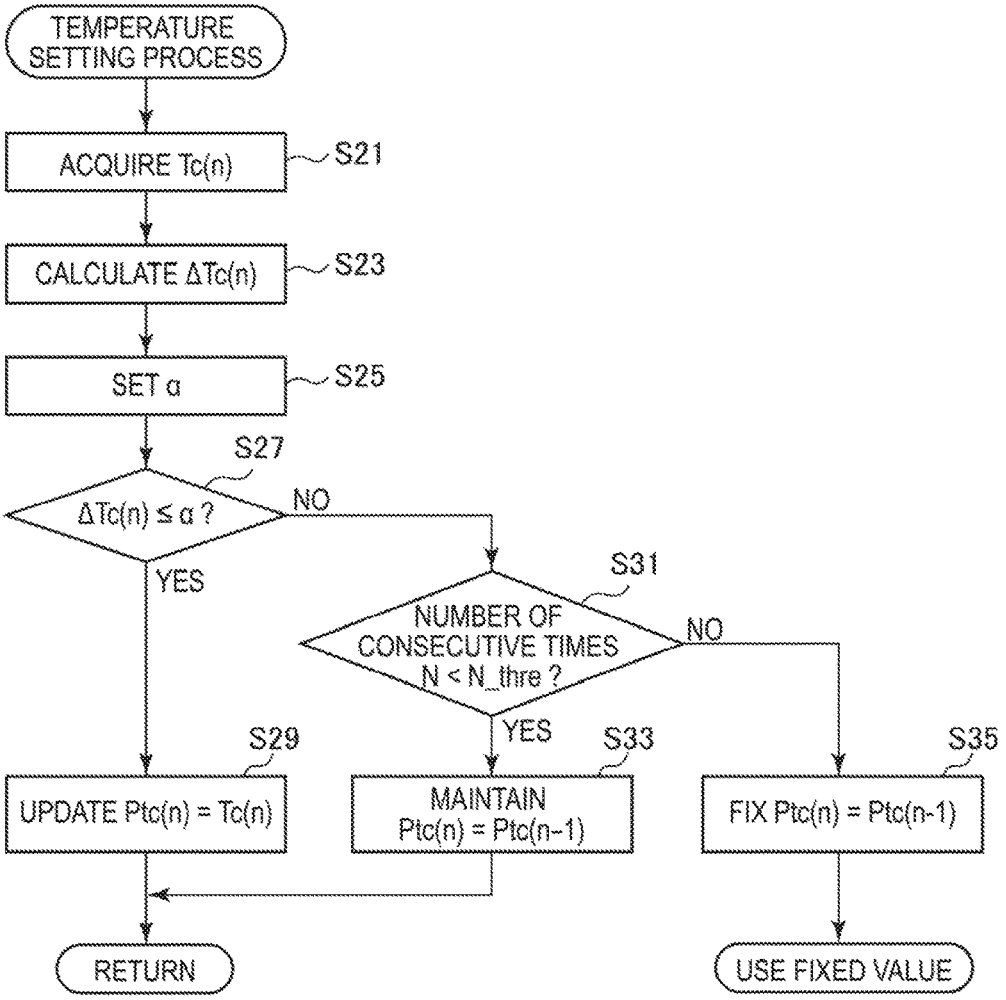
FIG. 8 is a flowchart illustrating a sequence of a cooling water temperature setting process according to the example.

Heretofore, the exemplary configuration of the fail safe device (ECU) 100 of the engine according to the present example has been described. In the following, an example of a flowchart of the fail safe process of the engine executed by the ECU 100 according to the present example will be described with reference to FIGS. 7 and 8. FIG. 7 is a flowchart of a main routine of the fail safe process, and FIG. 8 is a flowchart of a setting process of the set value Ptc of the cooling water temperature that is used in the estimation of the generation torque Tq_est of the engine 10. The computation processing illustrated in these flowcharts may be always executed during a period in which the ignition switch of the engine 10 is turned on, for example.

As illustrated in FIG. 7, first, the temperature setting module 116 of the controller 110 calculates the set values Ptc, Pto, Pta of the cooling water temperature Tc, the oil temperature To, and the intake air temperature Ta, which are used in the estimation of the generation torque Tq_est of the engine 10 (S11). Either one of the set value Ptc of the cooling water temperature and the set value Pto of the oil temperature may be set. Here, the flowchart of the setting process of the set value Ptc of the cooling water temperature will be described, as an example of the setting process of the temperature parameter that is used in the estimation of the generation torque Tq_est of the engine 10.

As illustrated in FIG. 8, first, the temperature setting module 116 of the controller 110 acquires the input value Tc(n) of the cooling water temperature calculated by the temperature calculator 112 (S21). The acquired input value Tc(n) of the cooling water temperature is calculated by the temperature calculator 112, on the basis of the sensor signals input via the A/D converter 107, while performing a denoising process or the like, for example.

Thereafter, the temperature setting module 116 calculates the change amount ΔTc(n) of the cooling water temperature in the process cycle of this time, on the basis of the difference between the input value Tc(n) of the cooling water temperature input this time and the set value Ptc(n−1) of the cooling water temperature set at the present moment (S23). This change amount ΔTc(n) of the cooling water temperature may be the absolute value of the difference between the input value Tc(n) of the cooling water temperature input this time and the set value Ptc(n−1) of the cooling water temperature set at the present moment, or in the case of the cooling water temperature, may be a value obtained by subtracting the set value Ptc(n−1) of the cooling water temperature set at the present moment from the input value Tc(n) of the cooling water temperature input this time. This is because it is more important to detect a sharp fall of the cooling water temperature, in order to reduce the sudden acceleration of the vehicle that is not intended by the driver.

Thereafter, the temperature setting module 116 sets the change amount restrictive value α for determining whether the input value Tc(n) of the cooling water temperature is an abnormal value (S25). The change amount restrictive value α may be set by using the above equation (1) or (2), for example. Note that the order of step S23 and step S25 may be inverted.

Thereafter, the temperature setting module 116 determines whether the change amount ΔTc(n) of the cooling water temperature in the present process cycle is equal to or smaller than the change amount restrictive value α (S27). If the change amount ΔTc(n) of the cooling water temperature is equal to or smaller than the change amount restrictive value α (S27:Yes), the temperature setting module 116 updates the current set value Ptc(n−1) with the input value Tc(n) of the cooling water temperature of this time, and sets the input value Tc(n) as the set value Ptc(n) that is used in the estimation of the generation torque Tq_est of the engine 10 (S29).

On the other hand, if the change amount ΔTc(n) of the cooling water temperature exceeds the change amount restrictive value α (S27:No), the temperature setting module 116 determines whether the number N of times when the change amount ΔTc(n) of the cooling water temperature consecutively exceeds the change amount restrictive value α is smaller than a preset threshold value N_thre (S31). The threshold value N_thre is a value set as appropriate to evaluate the reliability of the input value Tc(n) of the cooling water temperature, and is set to "3" in the above example of the FIG. 3.

If the number N of consecutive times is smaller than the threshold value N_thre (S31:Yes), the temperature setting module 116 maintains the set value Ptc(n−1) of the cooling water temperature set at the present moment, as the set value Ptc(n) of this time as it is (S33). On the other hand, if the number N of consecutive times reaches the threshold value N_thre (S31:No), the temperature setting module 116 fixes the set value Ptc(n) of the cooling water temperature that is used in the subsequent estimation of the generation torque Tq_est of the engine 10 to the set value Ptc(n−1) set at the present moment. After the set value Ptc(n) of the cooling water temperature is set to the fixed value, the setting of the fixed value is maintained while the ignition switch of the engine 10 is turned on, and the setting of the fixed value may be canceled when the ignition switch is turned off, for example.

As illustrated in the flowchart of this FIG. 8, if the change amount ΔTc(n) of the input value Tc(n) of the cooling water temperature relative to the current set value Ptc(n−1) does not exceed the maximum change amount (the change amount restrictive value α) that is estimated in each process cycle, the temperature setting module 116 sets the input value Tc(n) to the set value Ptc(n) that is used in the estimation of the generation torque Tq_est of the engine 10. On the other hand, if the change amount ΔTc(n) of the input value Tc(n) of the cooling water temperature relative to the current set value Ptc(n−1) exceeds the change amount restrictive value α, the input value Tc(n) is determined to be an abnormal value, and thus the temperature setting module 116 maintains the current set value Ptc(n−1) as the set value Ptc(n) of this time.

Further, if the number N of times when the change amount ΔTc(n) of the input value Tc(n) of the cooling water temperature relative to the current set value Ptc(n−1) consecutively exceeds the change amount restrictive value α reaches the threshold value N_thre, the temperature setting module 116 determines that the input value Tc(n) of the cooling water temperature is not reliable any more, and fixes the subsequent set value Ptc(n) to the current set value Ptc(n−1). Thereby, the abnormal input value or the unreliable input value of the cooling water temperature is prevented from being used in the estimation of the generation torque Tq_est of the engine 10.

Note that the set value Pto of the oil temperature or the set value Pta of the intake air temperature can also be set by the same process procedure as the flowchart illustrated in FIG. 8. Note that, in the case of the intake air temperature, it is important to determine whether the value obtained by subtracting the current set value Pta(n−1) from the input value Ta(n) of the intake air temperature of this time does not exceed the predetermined change amount restrictive value α. This is because it is more important to detect a sharp increase in the intake air temperature, in order to prevent the sudden acceleration of the vehicle that is not intended by the driver. The change amount restrictive value α used in the setting of the set value Ptc of the cooling water temperature, the set value Pto of the oil temperature, and the set value Pta of the intake air temperature may be set to different values in accordance with the temperature change amounts that can be estimated for each temperature.

Returning to FIG. 7, in step S11, the set value Ptc of the cooling water temperature, the set value Pto of the oil temperature, and the set value Pta of the intake air temperature are set, and thereafter the torque estimation module 118 of the controller 110 estimates the generation torque Tq_est of the engine 10 (S13). For example, the torque estimation module 118 calculates the basic generation torque on the basis of the engine speed Ne, the intake air amount, the fuel injection amount, the ignition timing, etc., by using a torque calculation map or the like. In this case, the torque estimation module 118 may correct the basic generation torque on the basis of the intake air temperature Ta that can have an influence on the oxygen concentration in the intake air. Also, the torque estimation module 118 estimates the net generation torque Tq_est, by subtracting minus elements of the torque, such as the engine friction, the load of the air conditioning device, the load of the alternator, and the load of the transmission, from the calculated basic generation torque. In this case, the engine friction can be set on the basis of one or both of the cooling water temperature Tc and the oil temperature To.

Thereafter, the torque monitoring module 120 of the controller 110 determines whether the value obtained by subtracting the expected torque Tq_exp from the estimated generation torque Tq_est of the engine 10 exceeds the preset threshold value β (S15). The threshold value β may be set to an appropriate value in accordance with the specification of the engine 10, the allowable range of the acceleration of the vehicle, etc., for example.

If the value obtained by subtracting the expected torque Tq_exp from the estimated generation torque Tq_est of the engine 10 exceeds the threshold value β, the torque monitoring module 120 determines that the estimated generation torque Tq_est of the engine 10 sharply increases, and outputs a drive command to the throttle drive circuit 105, in order to fix the air intake throttle opening degree to the limp home opening degree. The limp home opening degree may be an air intake throttle opening degree that can ensure a sufficient intake air amount to enable escape traveling, or may be set to 0% to stop the engine 10 immediately. Thereby, sudden acceleration of the vehicle that is not intended by the driver is ended immediately.

On the other hand, if the value obtained by subtracting the expected torque Tq_exp from the estimated generation torque Tq_est of the engine 10 does not exceed the threshold value β, the sharp increase in the estimated generation torque Tq_est of the engine 10 is not observed, and thus the torque monitoring module 120 ends the present routine and returns to step S11 to repeat each process step along the procedure described above.

In the fail safe process of the engine 10 according to the present example, when the input values Tc, To, Ta of the temperature parameters indicate an abnormal value, or when the reliabilities of those input values Tc, To, Ta decrease, the set values Ptc, Pto, Pta of the current temperature parameters are maintained, and the generation torque Tq_est of the engine 10 is estimated. Thus, the generation torque Tq_est of the engine 10 is not estimated by using the input values Tc, To, Ta of the temperature parameters indicating the abnormal value, and the sudden acceleration of the vehicle that is not intended by the driver can be detected accurately by the sharp increase in the estimated generation torque Tq_est of the engine 10.

As described above, the fail safe device (ECU) 100 of the engine 10 according to the present example sets the input value (Tc(n), To(n), Ta(n)) as the set value (Ptc(n), Pto(n), Pta(n)) and estimates the generation torque Tq_est of the engine 10, when the difference between the input value (Tc(n), To(n), Ta(n)) of the temperature parameter and the current set value (Ptc(n−1), Pto(n−1), Pta(n−1)) does not exceed the predetermined change amount restrictive value α. On the other hand, the fail safe device 100 of the engine 10 maintains the current set value (Ptc(n−1), Pto(n−1), Pta(n−1)) and estimates the generation torque Tq_est of the engine 10, when the difference between the input value (Tc(n), To(n), Ta(n)) of the temperature parameter and the current set value (Ptc(n−1), Pto(n−1), Pta(n−1)) exceeds the predetermined change amount restrictive value α.

Thus, the generation torque Tq_est of the engine 10 is not estimated by using the input value (Tc(n), To(n), Ta(n)) of the temperature parameter indicating an abnormal value, and thereby sudden acceleration of the vehicle that is not intended by the driver is accurately detected on the basis of the estimated generation torque Tq_est of the engine 10. Thereby, the fail safe function of the engine 10 is guaranteed, even when the temperature parameter indicates an abnormal value.

Also, the fail safe device 100 of the engine 10 according to the present example increases the change amount restrictive value α, when the difference between the input value (Tc(n), To(n), Ta(n)) of the temperature parameter and the current set value (Ptc(n−1), Pto(n−1), Pta(n−1)) consecutively exceeds the predetermined change amount restrictive value α. Thus, it is less possible that the input value of the temperature parameter, which could have changed actually, is determined to be an abnormal value.

Further, the fail safe device 100 of the engine 10 according to the present example fixes the subsequent set value to the current set value (Ptc(n−1), Pto(n−1), Pta(n−1)), when the number N of times when the difference between the input value (Tc(n), To(n), Ta(n)) of the temperature parameter and the current set value (Ptc(n−1), Pto(n−1), Pta(n−1)) consecutively exceeds the predetermined change amount restrictive value α exceeds a preset threshold value N_thre. Thus, the generation torque Tq_est of the engine 10 is never estimated by using the input value (Tc(n), To(n), Ta(n)) that is not reliable any more. Thus, the fail safe device 100 of the engine 10 according to the present example can guarantee the fail safe function, even when the input value (Tc(n), To(n), Ta(n)) of the temperature parameter is abnormal.

Although the preferred examples of the present invention have been described in detail with reference to the appended drawings, the present invention is not limited thereto. It is obvious to those skilled in the art that various modifications or variations are possible insofar as they are within the technical scope of the appended claims or the equivalents thereof. It should be understood that such modifications or variations are also within the technical scope of the present invention.

For example, although, in the above example, the temperature setting module compares the difference between the input value of the temperature parameter and the current set value with the change amount restrictive value to determine whether the input value is an abnormal value, the present invention is not limited to this example. The temperature setting module may set an upper limit value obtained by adding the change amount restrictive value to the current set value or a lower limit value obtained by subtracting the change amount restrictive value from the current set value, and compare the input value with the upper limit value or the lower limit value.

Although, in the above example, the torque monitoring module fixes the air intake throttle opening degree to the limp home opening degree as the fail safe process at the time of the sharp increase in the estimated generation torque of the engine, the present invention is not limited to this example. For example, the torque monitoring module may fix the fuel injection amount to the limp home injection amount as the fail safe process of the engine. In this case, the limp home injection amount may be an injection amount that can maintain the idle speed of engine rotation, or may be set to zero to stop the engine immediately.

Also, in the fail safe device of the engine according to the present example, the controller including the temperature setting module, the torque estimation module, and the torque monitoring module may be configured as one function of a controller, such as a CPU, that executes drive control of the engine. When each module for providing the fail safe function is implemented by the CPU or the like, which also serves as a drive controller of the engine, and the abnormal value of the temperature parameter is used in both of the drive controller and the torque estimation module, it is concerned that the estimated generation torque of the engine becomes identical with the expected torque, and the abnormality of the generation torque of the engine is not detected. By applying the present invention to the CPU or the like, the engine generation torque is not estimated by using the abnormal value of the temperature parameter, and the sudden acceleration of the vehicle that is not intended by the driver can be detected on the basis of the abnormality of the estimated generation torque of the engine.

The invention claimed is:

1. A fail safe device of an engine comprising:

a temperature setting module configured to set a value of a predetermined temperature parameter used in an estimation of a generation torque of the engine;

a torque estimation module configured to estimate the generation torque of the engine by using a set value of the predetermined temperature parameter set by the temperature setting module; and a torque monitoring module configured to decrease the generation torque of the engine, when the generation torque estimated by the torque estimation module is larger than a driver expected torque by a predetermined value or more, wherein the temperature setting module maintains a current set value of the predetermined temperature parameter when a difference between an input value of the predetermined temperature parameter and the current set value exceeds a predetermined change amount restrictive value, and updates the set value with the input value of the predetermined temperature parameter when the difference between the input value of the predetermined temperature parameter and the current set value does not exceed the predetermined change amount restrictive value.

2. The fail safe device of an engine according to claim 1, wherein when the difference between the input value of the predetermined temperature parameter and the current set value exceeds the predetermined change amount restrictive value, the temperature setting module maintains the current set value of the predetermined temperature parameter and increases the predetermined change amount restrictive value for use in a next comparison.

3. The fail safe device of an engine according to claim 1, wherein the temperature setting module sets the predetermined change amount restrictive value ($\alpha$) on the basis of equation (1) below, $$\alpha=\alpha_0\times(N+1) \quad (1)$$

where $\alpha$ is the change amount restrictive value;

$\alpha_0$ is a standard restrictive value; and

N is a number of consecutive times that exceed the change amount restrictive value.

4. The fail safe device of an engine according to claim 2, wherein the temperature setting module sets the predetermined change amount restrictive value ($\alpha$) on the basis of equation (1) below, $$\alpha=\alpha_0\times(N+1) \quad (1)$$

where $\alpha$ is the change amount restrictive value;

$\alpha_0$ is a standard restrictive value; and

N is a number of consecutive times that exceed the change amount restrictive value.

5. The fail safe device of an engine according to claim 1, wherein when the difference between the input value of the predetermined temperature parameter and the current set value once exceeds the predetermined change amount restrictive value and then returns to the predetermined change amount restrictive value or less within a predetermined time, the temperature setting module updates the set value with the input value.

6. The fail safe device of an engine according to claim 2, wherein when the difference between the input value of the predetermined temperature parameter and the current set value once exceeds the predetermined change amount restrictive value and then returns to the predetermined change amount restrictive value or less within a predetermined time, the temperature setting module updates the set value with the input value.

7. The fail safe device of an engine according to claim 1, wherein when the difference between the input value of the predetermined temperature parameter and the current set value once exceeds the predetermined change amount restrictive value and then does not return to the predetermined change amount restrictive value or less even after a predetermined time, the temperature setting module fixes a subsequent set value to the current set value.

8. The fail safe device of an engine according to claim 2, wherein when the difference between the input value of the predetermined temperature parameter and the current set value once exceeds the predetermined change amount restrictive value and then does not return to the predetermined change amount restrictive value or less even after a predetermined time, the temperature setting module fixes a subsequent set value to the current set value.

9. The fail safe device of an engine according to claim 1, wherein one or both of a cooling water temperature and an oil temperature of the engine are used as the predetermined temperature parameter, and the predetermined change amount restrictive value is a change amount restrictive value at a time of a decrease in the cooling water temperature or the oil temperature.

10. The fail safe device of an engine according to claim 2, wherein one or both of a cooling water temperature and an oil temperature of the engine are used as the predetermined temperature parameter, and the predetermined change amount restrictive value is a change amount restrictive value at a time of a decrease in the cooling water temperature or the oil temperature.

11. The fail safe device of an engine according to claim 1, wherein the predetermined temperature parameter is an intake air temperature, and the predetermined change amount restrictive value is a change amount restrictive value at a time of an increase in the intake air temperature.

12. The fail safe device of an engine according to claim 2, wherein the predetermined temperature parameter is an intake air temperature, and the predetermined change amount restrictive value is a change amount restrictive value at a time of an increase in the intake air temperature.

13. The fail safe device of an engine according to claim 1, wherein the temperature setting module, the torque estimation module, and the torque monitoring module are implemented in a computing unit configured to execute a drive control of the engine.

14. The fail safe device of an engine according to claim 2, wherein the temperature setting module, the torque estimation module, and the torque monitoring module are implemented in a computing unit configured to execute a drive control of the engine.

15. The fail safe device of an engine according to claim 1, wherein the torque monitoring module fixes an air intake throttle valve to a limp home opening degree.

16. The fail safe device of an engine according to claim 2, wherein the torque monitoring module fixes an air intake throttle valve to a limp home opening degree.

17. A fail safe device of an engine comprising:

circuitry configured to set a value of a predetermined temperature parameter used in an estimation of a generation torque of the engine, estimate the generation torque of the engine by using a set value of the predetermined temperature parameter that is set, and decrease the generation torque of the engine, when the estimated generation torque is larger than a driver expected torque by a predetermined value or more, wherein a current set value of the predetermined temperature parameter is maintained when a difference between an input value of the predetermined temperature parameter and the current set value exceeds a predetermined change amount restrictive value, and the set value is updated with the input value of the predetermined temperature parameter when the difference between the input value of the predetermined temperature parameter and the current set value does not exceed the predetermined change amount restrictive value.

* * * * *